US005369853A

United States Patent [19]

Okawa et al.

[11] Patent Number: 5,369,853

[45] Date of Patent: Dec. 6, 1994

[54] HOOK-AND-LOOP FASTENER

[75] Inventors: Mitsuhisa Okawa, Kurobe; Ryuichi Murasaki, Toyama, both of Japan

[73] Assignee: Yoshida Kogyo K.K., Tokyo, Japan

[21] Appl. No.: 94,340

[22] Filed: Jul. 20, 1993

[30] Foreign Application Priority Data

Jul. 31, 1992 [JP] Japan ..... 4-053969[U]

[51] Int. Cl.[5] ..... A44B 13/00

[52] U.S. Cl. ..... 24/446; 24/451

[58] Field of Search ..... 24/446, 449, 450, 448, 24/442, 451, 452; 66/194, 191

[56] References Cited

U.S. PATENT DOCUMENTS

| | | | |
|---|---|---|---|
| 3,387,345 | 6/1968 | Savoir | 24/446 |
| 3,708,382 | 1/1973 | Erb | 24/451 |
| 3,993,105 | 11/1976 | Diesner . | |
| 4,039,008 | 8/1977 | Diesner . | |
| 4,920,617 | 5/1990 | Higashinaka | 24/446 |
| 5,231,738 | 8/1993 | Higashinaka | 24/450 |

FOREIGN PATENT DOCUMENTS

| | | | |
|---|---|---|---|
| 2289651 | 5/1976 | France . | |
| 1685354 | 4/1970 | Germany . | |
| 13-22830 | 10/1938 | Japan . | |
| 47-46145 | 12/1972 | Japan . | |
| 49-33745 | 3/1974 | Japan . | |
| 60-163020 | 10/1985 | Japan . | |
| 63-1416 | 1/1988 | Japan . | |
| 2-111309 | 9/1990 | Japan . | |
| 4-6908 | 1/1992 | Japan . | |
| 4-19209 | 2/1992 | Japan . | |
| 5-154010 | 6/1993 | Japan . | |
| 0972648 | 10/1964 | United Kingdom | 24/446 |
| 1337317 | 11/1973 | United Kingdom . | |
| 1345607 | 1/1974 | United Kingdom . | |
| 1400080 | 7/1975 | United Kingdom . | |

*Primary Examiner*—Victor N. Sakran

*Attorney, Agent, or Firm*—Hill, Steadman & Simpson

[57] ABSTRACT

A hook-and-loop fastener comprising a base web, a multiplicity of hook elements and loop elements mounted on the base web in rows and vertical lines. In each row, each hook element adjoining a loop element on each side thereof. The distribution ratio of the hook elements to the total of the hook elements and loop elements is approximately 33 percent. Each loop element is 1 mm higher than each hook element. Each hook element is made of thermoplastic monofilament of 400 through 700 denier.

9 Claims, 3 Drawing Sheets

HOOK-AND-LOOP FASTENER

BACKGROUND OF THE INVENTION

1. Field of the Invention

The present invention relates generally to a hook-and-loop fastener used for garments, pouches, baggages, covers, sheets etc., and more particularly to a hook-and-loop fastener having hook elements and loop elements mounted in mixed state on its single base web. Since having both hook elements and loop elements mixed thereon, the hook-and-loop fastener may be used in one piece; it has its one part engaged with the other part by folding it thereon. Alternatively, for the same reason, the hook-and-loop fastener may be cut and used in two pieces; the matching pieces of hook and loop fastener may be engaged with each other.

2. Description of the Prior Art

A first type of hook-and-loop fastener of the nature described above is disclosed in Japanese Patent Publication No. 38-22830. The conventional hook-and-loop fastener comprises a base web and a multiplicity of hook elements and loop elements mounted on the base web. Rows of hook elements and rows of loop elements may be arranged alternately on the web. Alternatively, hook elements and loop elements are arranged in mixed state in various ways.

A second type of hook-and-loop fastener is disclosed in Japanese Utility Model Laid-open Publication No. 4-6908. This conventional hook-and-loop fastener also comprises a base web and a multiplicity of hook elements and a multiplicity of of loop elements mounted on the base web. Each loop is about 1.5 mm to 4 mm high and is higher than each hook by about 0.1 mm to 2 mm. The distribution ratio of the loop elements relative to the total of the hook elements and the loop elements ranges from about 40 to about 60 percents. And, each hook element is made of a thermoplastic monofilament of about 330 denier.

A third type of hook-and-loop fastener is often seen on the market. In this conventional hook-and-loop fastener, two rows of hook elements regularly alternate with two rows of loop elements. And, each hook element is made of a thermoplastic monofilament of 360 denier.

However, these conventional hook-and-loop fasteners have drawbacks.

In the first type of conventional hook-and-loop fastener, two matching pieces of the hook-and-loop fastener touched to each other face-to-face are very likely to have almost the same patterns of hook and loop element with each other. In other words, almost all hook elements of one piece touches hook elements of the other piece, while almost all loop elements of one piece touches loop elements of the other piece. Due to much less engagement of hook elements and loop elements, intermeshing force of the hook-and-loop fastener is very weak.

In the second type of conventional hook-and-loop fastener, hook elements and loop elements are distributed approximately 50 to 50 on a base web. Since fewer loop elements are engaged with each hook elements, intermeshing force of the hook-and-loop fastener is very weak, so that the two matching pieces of hook-and-loop fastener are very liable to detachment from each other. Besides, the intermeshing forces of the hook-and-loop fastener extremely varies depending on where the matching pieces of the hook-and-loop fastener are joined. The same thing can be said with the third type of conventional hook-and-loop fastener.

SUMMARY OF THE INVENTION

With the foregoing difficulties in view, it is therefore an object of the present invention to provide a hook-and-loop fastener wherein two parts or two matching pieces of hook-and-loop fastener are not of the same patter so that the intermeshing forces of the parts or matching pieces of hook-and-loop fastener is very strong.

According to the present invention, there is provided a hook-and-loop fastener comprising a base web, a multiplicity of hook elements and loop elements mounted on the base web in rows and vertical lines; in each row, each hook element adjoining a loop element on each side thereof: the distribution ratio of the hook elements to the total of the hook elements and loop elements being approximately 33 percent; each loop element being 1 mm higher than each hook element; and each hook element being made of thermoplastic monofilament of 400 through 700 denier.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
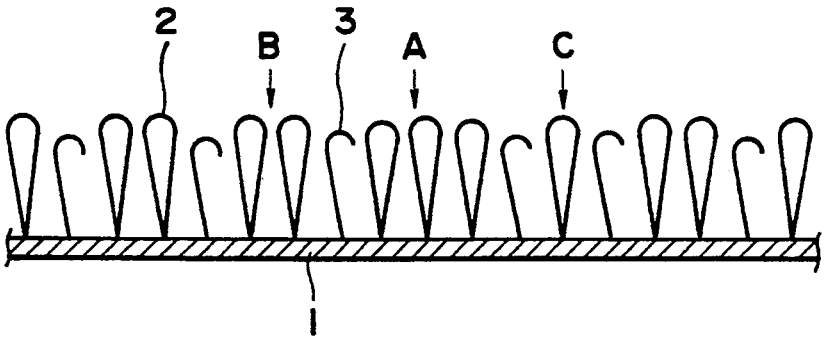
FIG. 1 is a diagrammatical cross-sectional view of a hook-and-loop fastener according to the present invention.
Figure 5:
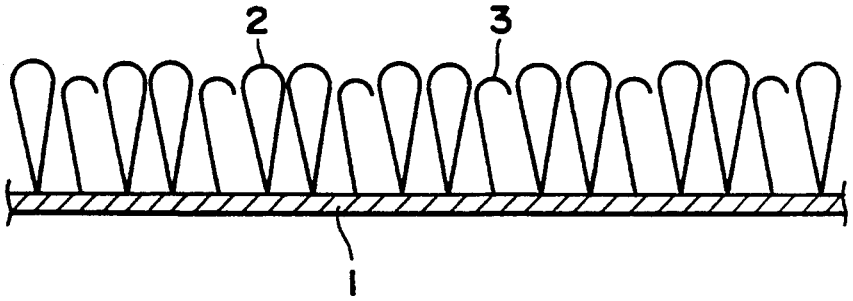
FIG. 5 is a view similar to FIG. 1, but showing yet another embodiment of the present invention.
Figure 6:
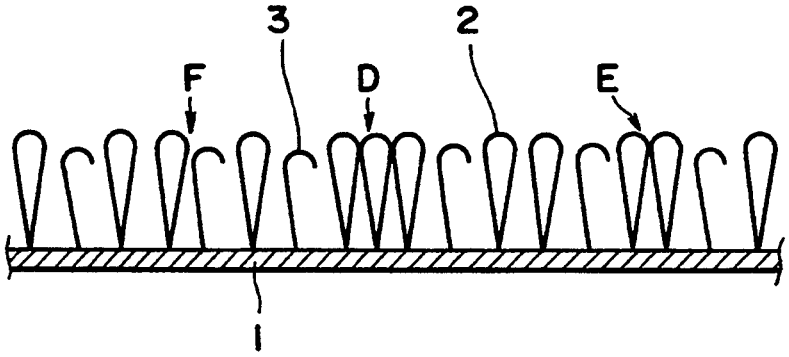
FIG. 6 is a view similar to FIG. 1, but showing still another embodiment of the present invention.

Referring now to FIGS. 1, 5 and 6, a hook-and-loop fastener according to the present invention comprises a woven or knitted base web 1, a multiplicity of loop elements 2 and a multiplicity of hook elements 3 mounted in rows and columns on the base web 1. The distribution ratio of the hook elements 3 relative to the total of the hook elements 3 and the loop elements 2 is approximately 33 percent. In each row, each hook element adjoins a loop element on each side thereof. In each row, hook elements 3 and loop elements 2 may be arranged without any regular sequence. In other words, variant numbers of the loop elements 3 may be irregularly interposed between the hook elements 2. To be specific, as shown in FIG. 1, three, two and one loop elements 2 are interposed between the hook elements 3 in the inter-hook regions A, B and C, respectively.

As shown in FIG. 5, two loop elements 2 may be interposed between every adjacent hook elements 3. In other words, two loop elements 2 may alternate with one hook element 3.

Furthermore, the distance between adjacent loop elements 2, 2 and the distance between adjacent hook element 3 and loop element 2 may be non-uniform, or vary from one place to another. As shown in FIG. 6, the distance between each adjacent loop elements 2 in regions D and E is much less than that in other regions; and the distance between the hook element 3 and the adjacent loop element 2 in region F is less than that in other regions.

Figure 2:
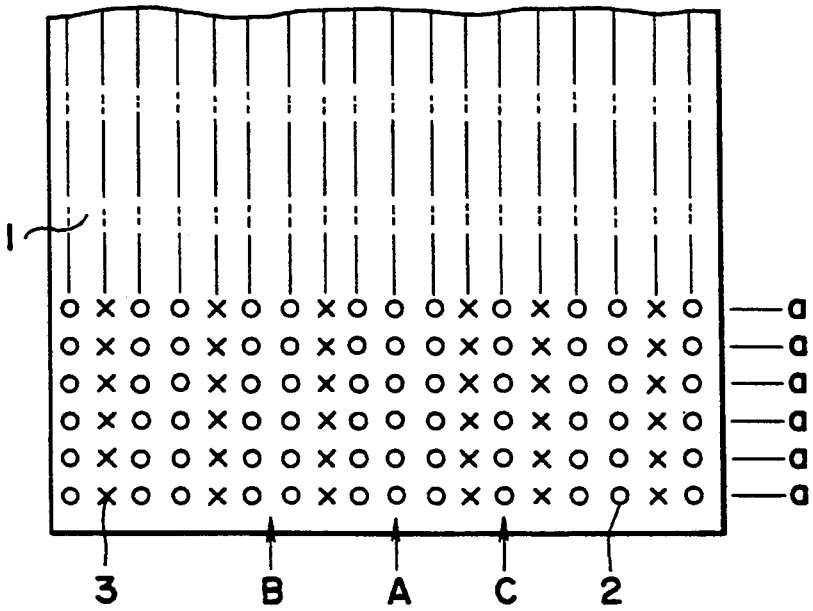
FIG. 2 is a diagrammatical plan view of the hook-and-loop fastener of FIG. 1.
Figure 3:
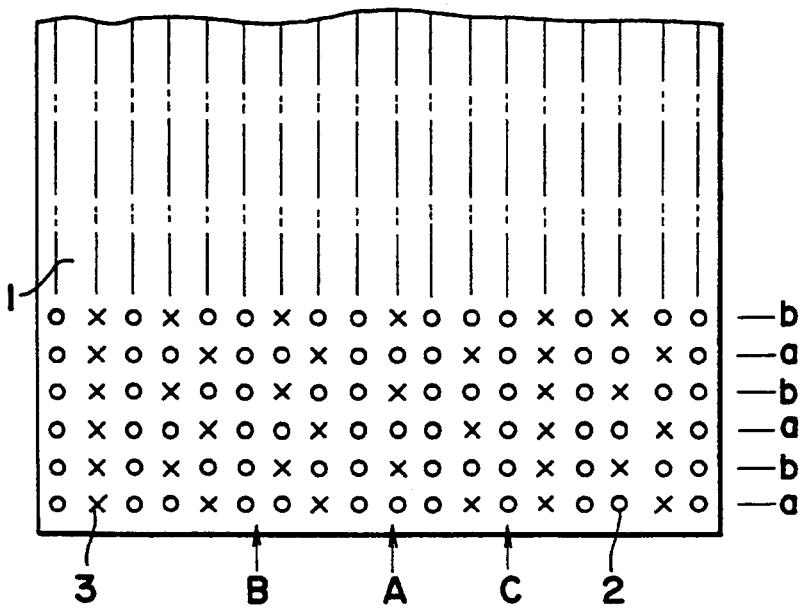
FIG. 3, is a similar view to FIG. 2, but showing another embodiment of the present invention.
Figure 4:
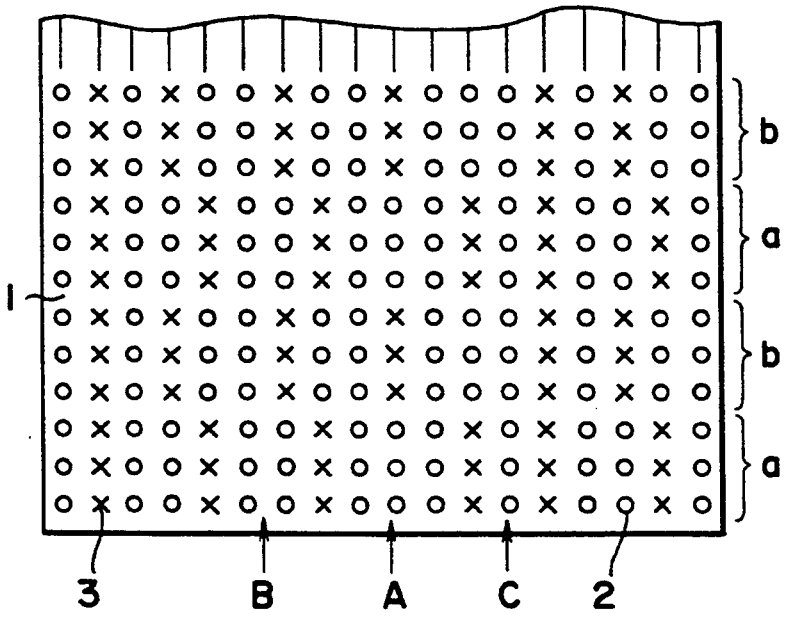
FIG. 4 is also a similar view to FIG. 2, but showing still another embodiment of the present invention.

The arrangement of hook elements 3 and loop elements 2 shown in FIG. 1 may be repeated straight in every following row like a, a, a, a, a . . . , as shown in FIG. 2, which means that either hook elements 3 or loop elements 2 are ganged straight in each column. Alternatively, as shown in FIG. 3, the arrangement may be staggered every other row, like a, b, a, b, a, b, . . . . Furthermore, as shown in FIG. 4, the arrangement may be staggered every fourth row, like a, a, a; b, b, b; a, a, a; b, b, b; . . . .

Each loop element 2 is made of a multifilament of thermoplastic such as polyamide, polyester, polypropylene or the like. The loop elements 2 are formed by napping the fabric made of the materials mentioned above. Each hook element 3 is made of a monofilament of thermoplastic materials such as mentioned above and of 400 to 700 denier. Each loop element 2 is 1 mm higher than each hook element 3.

As mentioned above, each hook element 3 adjoins a loop element 2 on each side thereof and each loop element 2 is 1 mm higher than each hook element 3. These two features are combined to thus ensure that, when the two matching pieces of hook-and loop fastener are touched face-to-face to each other, the hook elements 3 and the loop elements 2 of the matching pieces are firmly engaged with each other.

With the construction set forth hereinabove, the hook-and-loop fastener according to the present invention enjoys the following advantages.

Since the hook-and-loop fastener has much more loop elements per a unit area than any conventional hook-and-loop fastener; the hook-and-loop fastener is still flexible, although it has its hook elements made of monofilaments of 400 to 700 denier, instead of the conventional ones of 330 to 360 denier, in order to enhance intermeshing forces of the matching pieces.

In the hook-and-loop fastener according to the present invention hook elements and loop elements can intermesh with each other more firmly than in any conventional hook-and-loop fastener. The hook-and-loop fastener is more immune from being accidentally peeled from a companion hook-and-loop fastener.

Since each loop element is higher than each hook element, the hook-and-loop fastener enjoys increased intermeshing forces.

The distance between adjacent loop elements and the distance between adjacent hook element and loop element are nonuniform. This helps to prevent a piece of hook-and-loop fastener from having the same pattern as the matching piece, thus leading to increased intermeshing forces of the matching pieces.

Obviously, various modifications and variations of the present invention are possible in the light of the above teaching. It is therefore to be understood that within the scope of the appended claims the invention may be practiced otherwise than as specifically described.

What is claimed is:

1. A hook-and-loop fastener comprising a base web, a multiplicity of hook elements and loop elements mounted on the base web in rows and columns; in each row, each hook element adjoining a loop element on each side thereof; the distribution ratio of the hook elements to the total of the hook elements and loop elements being about 33 percent provides a strong interaction between companion of said multiplicity of the hook and loop elements; each loop element being higher than each hook element; and each hook element being made of thermoplastic monofilament of 400 through 700 denier.

2. A hook-and-loop fastener according to claim 1, in each row, hook elements and loop elements being arranged in an irregular sequence.

3. A hook-and-loop fastener according to claim 1, either hook elements or loop elements being arranged straight in each column, one line of hook elements alternating with two lines of loop elements.

4. A hook-and-loop fastener according to claim 1, the distances between adjacent loop elements and the distances between adjacent hook element and loop element varying from one place to another.

5. A hook and loop fastener according to claim 1, wherein each row comprises groupings of three loop elements, two loop elements and single loop elements, said groupings arranged between hook elements.

6. A hook and loop fastener according to claim 5, wherein each said row comprises an identical pattern of hook and loop elements wherein first groups of at least one row are laterally offset from second groups of at least one row in a repeating row pattern along a length of the columns.

7. A hook and loop fastener according to claim 5, wherein a first distance between adjacent loop elements in said groupings of three loop elements is smaller than a second distance between adjacent loop elements in said groupings of two loop elements.

8. A hook and loop fastener according to claim 1, wherein across said rows said loop elements are grouped between hook elements with a variable spacing between loop elements.

9. A hook and loop fastener according to claim 1, wherein said loop elements are arranged between hook elements with variable number of loop elements between hook elements and variable spacing between loop elements across each row.

* * * * *